US011684933B2

(12) United States Patent
Lin et al.

(10) Patent No.: US 11,684,933 B2
(45) Date of Patent: Jun. 27, 2023

(54) SPRAY GUN SHOWER HEAD

(71) Applicant: JOMOO KITCHEN & BATH CO., LTD., Fujian (CN)

(72) Inventors: Xiaofa Lin, Fujian (CN); Xiaoshan Lin, Fujian (CN); Yinan Zheng, Fujian (CN); Haokuan Chen, Fujian (CN)

(73) Assignee: JOMOO KITCHEN & BATH CO., LTD., Fujian (CN)

( * ) Notice: Subject to any disclaimer, the term of this patent is extended or adjusted under 35 U.S.C. 154(b) by 343 days.

(21) Appl. No.: 17/042,949

(22) PCT Filed: Aug. 12, 2019

(86) PCT No.: PCT/CN2019/100154
§ 371 (c)(1),
(2) Date: Sep. 29, 2020

(87) PCT Pub. No.: WO2020/232843
PCT Pub. Date: Nov. 26, 2020

(65) Prior Publication Data

US 2022/0250097 A1 Aug. 11, 2022

(30) Foreign Application Priority Data

May 22, 2019 (CN) ..... 201910430788.2

(51) Int. Cl.
*B05B 1/16* (2006.01)
*B05B 1/10* (2006.01)
*B05B 1/18* (2006.01)

(52) U.S. Cl.
CPC ..... *B05B 1/1636* (2013.01); *B05B 1/10* (2013.01); *B05B 1/1672* (2013.01); *B05B 1/18* (2013.01)

(58) Field of Classification Search
CPC ..... B05B 1/18; B05B 1/185; B05B 1/1636; B05B 1/1672
See application file for complete search history.

(56) References Cited

U.S. PATENT DOCUMENTS 3,811,618 A 5/1974 Gartner et al.
5,184,777 A * 2/1993 Magnenat ..... E03C 1/084 239/447
5,967,422 A 10/1999 Wang

FOREIGN PATENT DOCUMENTS

CN 208244985 12/2018
CN 208466214 2/2019
CN 110038741 7/2019

OTHER PUBLICATIONS

"International Search Report (Form PCT/ISA/210)" of PCT/CN2019/100154, dated Feb. 26, 2020, pp. 1-5.

(Continued)

*Primary Examiner* — Cody J Lieuwen
*Assistant Examiner* — Ayele A Tegegne
(74) *Attorney, Agent, or Firm* — JCIPRNET

(57) ABSTRACT

A spray gun shower head includes a shower body and a waterway closing element. The shower body is disposed with a first water passageway communicated with a water intake opening and a first water outflow opening (12), and a second water passageway communicated with the water intake opening and a second water outflow opening. The second water passageway is configured to spray the spray gun water. The waterway closing element is rotatable to a second switch position to open the second water passageway and close the first water passageway while driving an opening structure to push against a cover to be flipped up, so that the second water outflow opening hidden in the shower body by the cover sprays the spray gun water.

7 Claims, 7 Drawing Sheets

(56) References Cited

OTHER PUBLICATIONS

"Written Opinion of the International Searching Authority (Form PCT/ISA/237)" of PCT/CN2019/100154, dated Feb. 26, 2020, pp. 1-5.

* cited by examiner

SPRAY GUN SHOWER HEAD

CROSS-REFERENCE TO RELATED APPLICATION

This application is a 371 of international application of PCT application serial no. PCT/CN2019/100154, filed on Aug. 12, 2019, which claims the priority benefit of China application no. 201910430788.2, filed on May 22, 2019. The entirety of each of the above mentioned patent applications is hereby incorporated by reference herein and made a part of this specification.

BACKGROUND

Technical Field

The disclosure relates to the field of sanitary ware, and in particular to a spray gun shower head.

Description of Related Art

At present, the existing shower heads do not have the spray gun water function, so two shower heads are usually combined, one is a normal shower head and the other is a spray gun shower head. The water impact of the normal shower head is suitable for body bathing while the spray gun shower head has a strong water potential, which is used to wash the bathroom wall and floor. Generally, the spray gun water is provided with a higher water pressure from 0.5 bar to 5 bar, for washing or cleaning. The existing combination has certain defects: (1) the cost is high as the cost of two shower heads is required; (2) a lot of bathroom space is taken up as a larger space is required to place the spray gun shower head; and (3) it is difficult to add a new spray gun function when a single-function shower head has already been installed as a new water outflow pipeline needs to be added for connection.

In order to improve the above situations, the existing research and development personnel have added a spray gun water function to the normal shower head, which is disposed on the back part of the shower head through a single assembly. Although such method improves the defect of disposing two shower heads separately, the structure becomes very complicated with reasons as follows: independent structures are needed to implement independent control, and it is difficult to solve the problem of water sealing when the structure for spraying spray gun water is connected to the intake waterway, so water leakage may easily occur. The problem of water leakage needs to be further solved with a complex structure.

In summary, the structure of the existing shower head with spray gun function is too complicated, which is independently operated through multiple operating structures, has high cost, and cannot be integrated with other functions when being used. Therefore, the existing spray gun shower head still has room for further improvement.

SUMMARY

The objective of the disclosure is to solve the existing problems and provide a spray gun shower head, which has a simple structure, a reasonable design, and easy implementation. The existing function and the spray gun functions are integrated in the same operating structure, making it easier for a user to operate and for better user experience. In addition, the water outflow opening of the spray gun water is hidden and covered, which has very good protective and usage prompt effects.

To achieve the above objectives, the disclosure adopts the following technical solutions.

A spray gun shower head includes the following.

A shower body has a water intake opening and at least one first water outflow opening and second water outflow opening.

A waterway closing element moves between at least two first and second switch positions. The waterway closing element opens a first water passageway oriented from the water intake opening toward the first water outflow opening and cuts off a second water passageway oriented from the water intake opening toward the second water outflow opening in the first switch position.

The second water passageway is configured as a passageway for spraying spray gun water. The second water outflow opening and the second water passageway are hidden in the shower body through a cover. The cover is pushed against by an opening structure to be opened. The waterway closing element is configured as a water dividing member that is at least rotatable. The waterway closing element is rotated to the second switch position, drives the opening structure to push against the cover to be flipped up, cuts off the first water passageway oriented from the water intake opening toward the first water outflow opening, and opens the second water passageway oriented from the water intake opening toward the second water outflow opening.

Further, the opening structure includes a push block. The push block is configured on the waterway closing element. A passive part that cooperates with the push block is disposed on the cover. The waterway closing element rotates to link with the push block thereon to press against the passive part, so that the cover opens relative to the shower body and opens the second water passageway oriented from the water intake opening toward the second water outflow opening.

Further, the cover is hinged to the shower body.

Further, the opening structure further includes a movable element and an elastic member. The movable element is movably disposed on the shower body. The movable element forms an attachment part that cooperates with the passive part on the cover and a pressure part that pushes against the movable element to move through the push block. Two ends of the elastic member respectively act on the shower body and the movable element, and are configured to drive the movable element to reset without being pressed against by the push block. The movable element is displaced after being pressed against by the push block and drives the cover to swing with the hinge axis as the fulcrum to open the second water outflow opening.

Further, the second water outflow opening is disposed on a top portion of the shower body, and a water outflow direction is arranged at an artificially set angle with a water outflow direction of the first water outflow opening. The cover is hinged to a back surface of the shower body and blocks the second water outflow opening.

Further, a stopping member is disposed on the shower body. The stopping member is switchable to move between at least two limiting positions. The stopping member located in a first limiting position opens the first water outflow opening. The stopping member moves into a second limiting position to limit the rotation of the waterway closing element to the second switch position, so as to prevent the second water outflow opening from spraying spray gun water upward when water supply is not stopped.

Further, the second limiting position is disposed on a rotational movement track of the push block. The stopping member falls into the second limiting position to restrict the waterway closing element from opening the second water outflow opening.

Further, a rib is disposed on the waterway closing element. The second limiting position is disposed on a rotational movement track of the rib. The stopping member falls into the second limiting position to restrict the rib from crossing over, so as to restrict the waterway closing element from opening the second water outflow opening.

Further, the movement direction of the stopping member from the first limiting position toward the second limiting position is opposite to the water outflow direction of the second water outflow opening.

Further, the stopping member is a gravity ball.

Compared with the prior art, the technical solutions of the disclosure have the following beneficial effects.

(1) The spray gun shower head provided by the disclosure has a simple structure, a reasonable design, and easy implementation. The switching function of the existing shower head and the spray gun function are integrated in the same rotational operating structure. Only one rotational structure is required to implement the spraying of the normal shower head water and the spraying of the spray gun water, which is easier for the user to operate and has better user experience. In addition, the water outflow opening of the spray gun water is covered and hidden with the cover, which not only has a good protective effect, but also serves as a prompt effect after opening the cover, so that the high-pressure spray gun water is not easily triggered.

(2) By the cooperation between the push block and the waterway closing element, the disclosure could implement the switching of the spray gun water while implementing the closing of the cover. Two functions are controlled by one action, which saves manufacturing costs and has a more compact structure.

(3) The cover of the disclosure is disposed on the shower body by adopting a hinged manner. The movable element and the elastic member serve as the transmission structure. The cover swings relative to the shower body and is opened by the rotational movement, and is automatically reset when switched to other functions (such as shower function).

(4) In the disclosure, the water outflow opening of the spray gun water is disposed on the top portion of the shower body and is disposed at a certain angle with a water outflow opening of the shower function, so that the water outflow opening of the spray gun water and the water outflow opening of the shower function are obviously distinguished. Also, when using the spray gun water function, the hand holding posture is more suitable and convenient for the user to use. In addition, the cover is hinged to the back surface of the shower body, which not only does not affect the water outflow and appearance of the shower head part, but also has a prompt effect on the back cover for using the high-pressure spray gun water.

(5) The disclosure also provides a stopping member, which has the effect of preventing false triggering. When the stopping member falls into the second limiting position, the waterway closing element cannot be rotated to the spray gun water mode, which prevents the user from opening the high-pressure spray gun water during the normal bathing process and prevents the user from spraying the spray gun water to the ceiling, bath heater, socket, etc. due to misoperation, so as to have a good protective effect.

(6) In the disclosure, the second limiting position is disposed in the rotational movement track of the push block. When the stopping member is in the second limiting position, the stopping member cannot be triggered. When the stopping member crosses over the second limiting position, the spray gun water may be continuously released.

(7) The disclosure uses the gravity ball as the stopping member. Also, the movement direction of the stopping member from the first limiting position toward the second limiting position is opposite to the direction of the second water outflow opening. Such configuration enables the stopping member to be always in the second limiting position when the spray gun opening is facing upward, which cannot be opened by misoperation.

BRIEF DESCRIPTION OF THE DRAWINGS

The drawings described here are used to provide further understanding of the disclosure and constitute a part of the disclosure. The exemplary embodiments and descriptions thereof of the disclosure are used to explain the disclosure and do not constitute any improper limitation of the disclosure.

DETAILED DESCRIPTION OF DISCLOSED EMBODIMENTS

Figure 1:
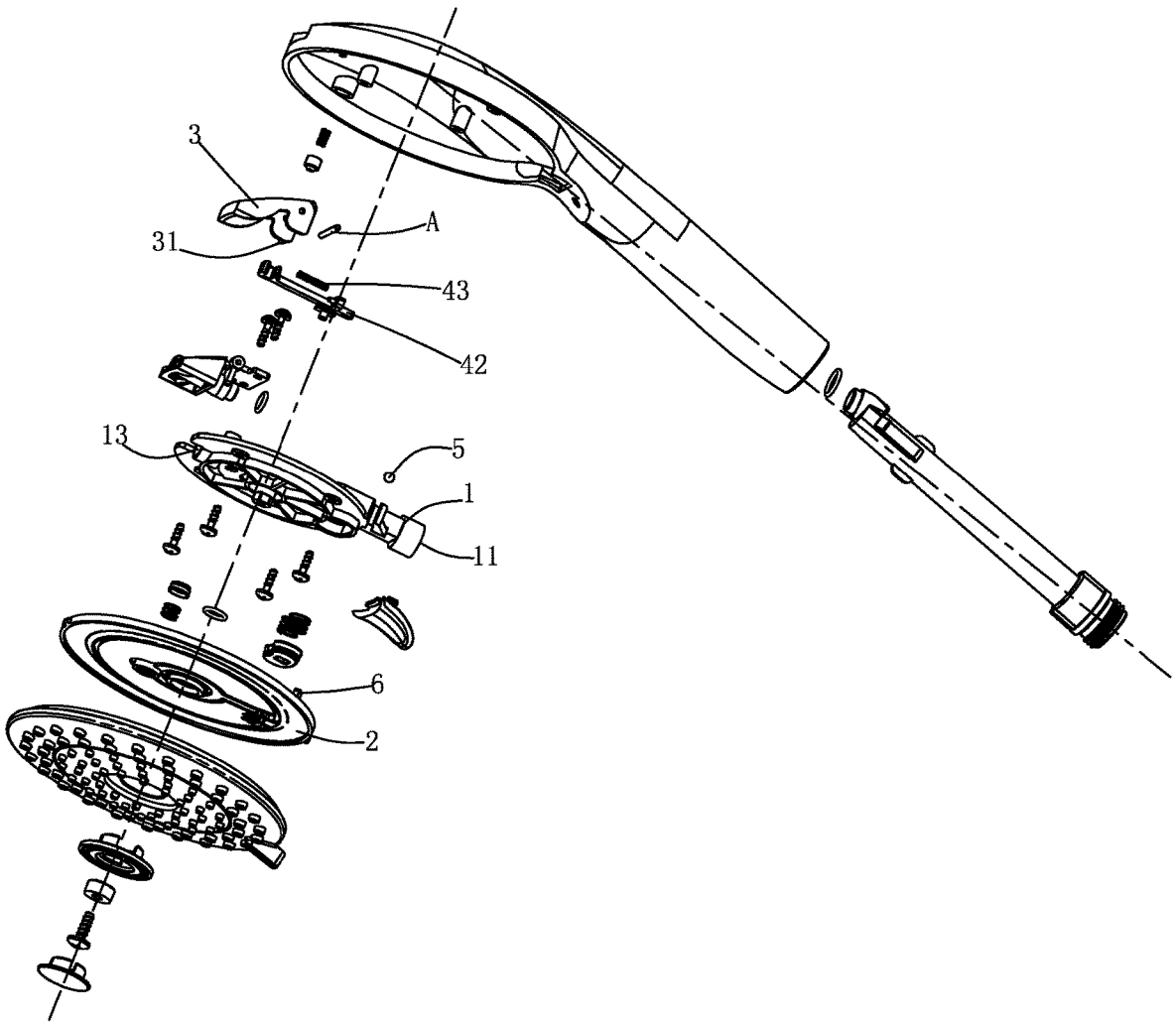
FIG. 1 is an exploded perspective schematic view of a spray gun shower head according to the disclosure.
Figure 2:
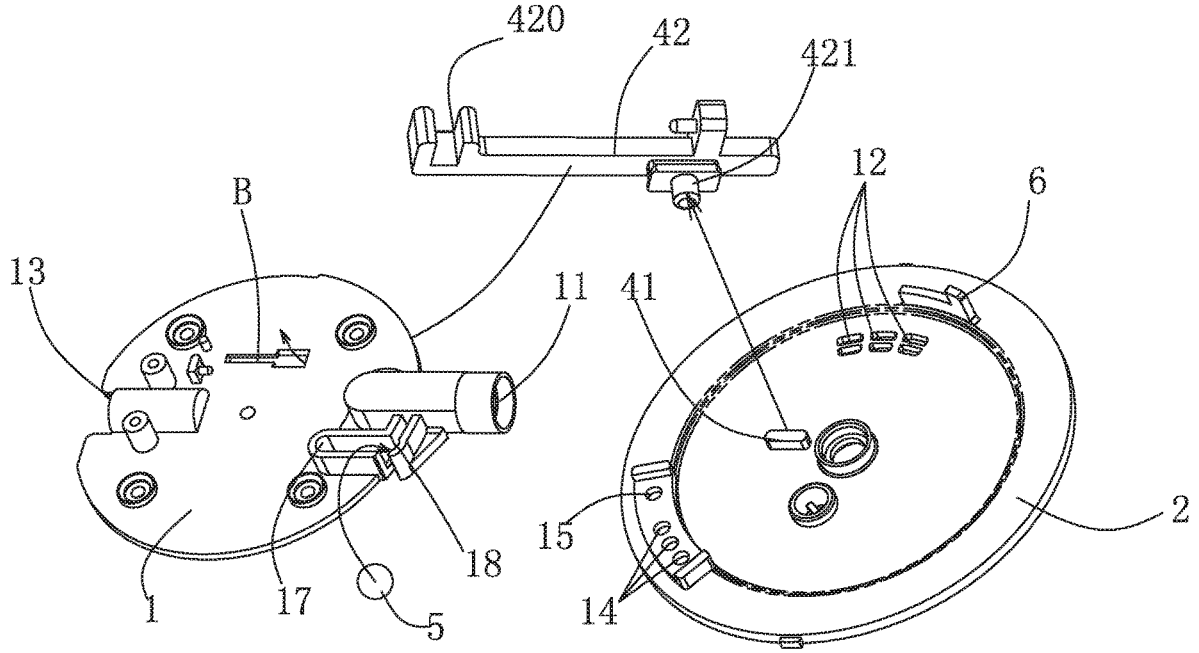
FIG. 2 is a schematic assembly view of a shower body, a waterway closing element and a movable element according to the disclosure.
Figure 3:
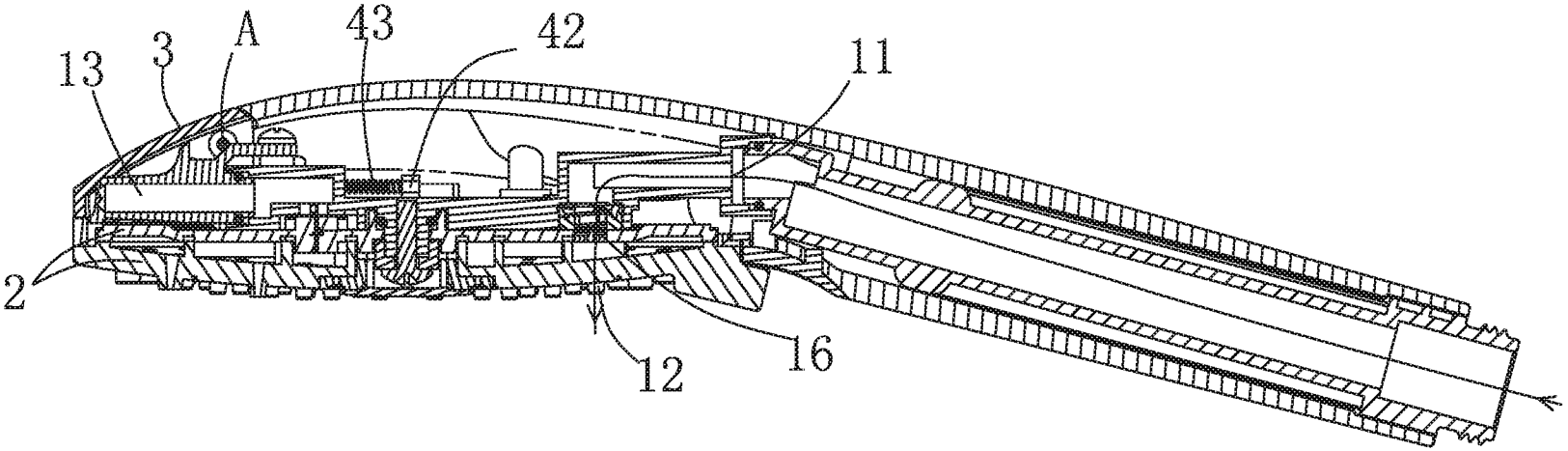
FIG. 3 is a cross-sectional view of the spray gun shower head in a shower function state according to the disclosure.
Figure 4:
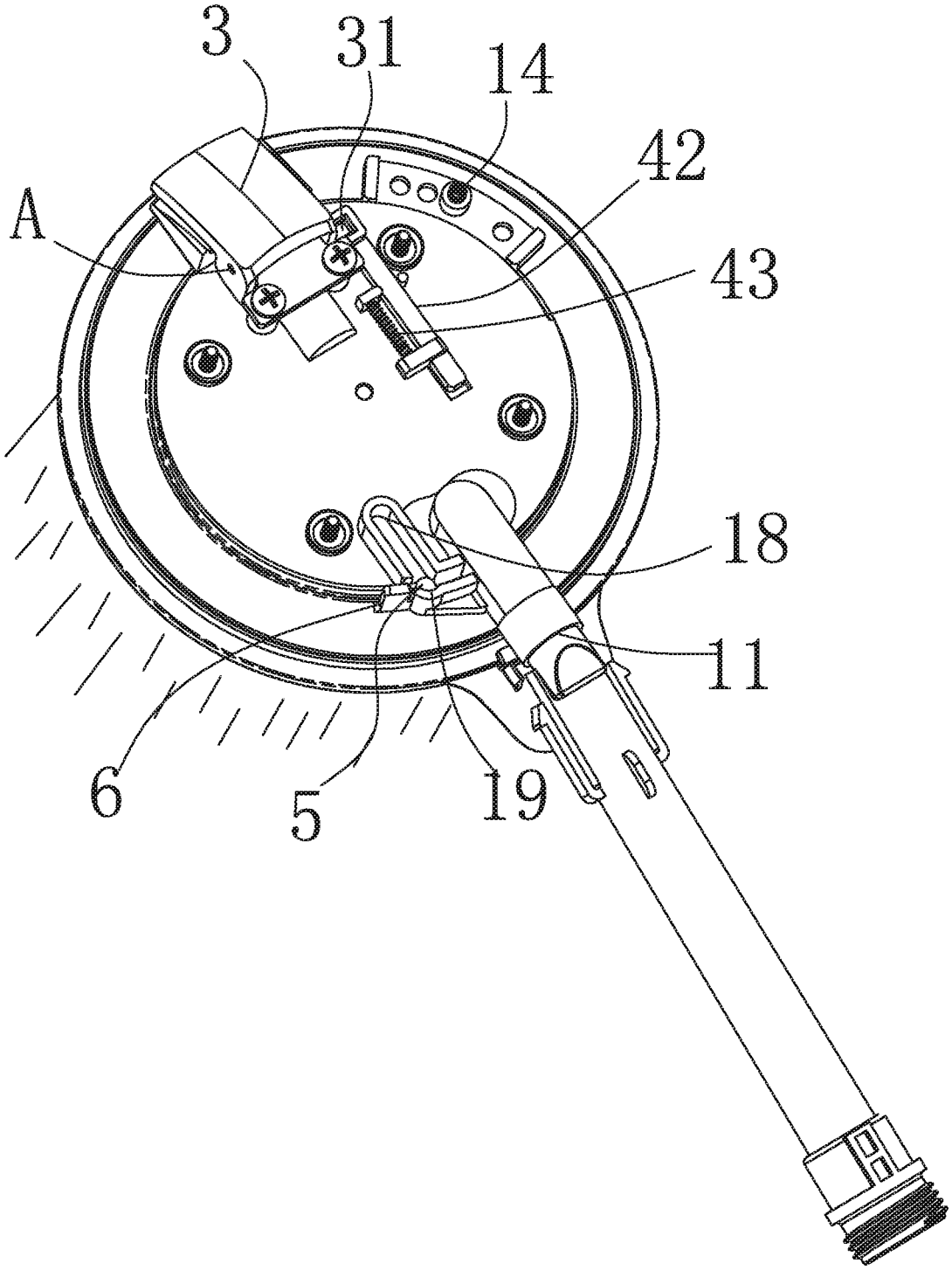
FIG. 4 is a three-dimensional view of a stopping member in a first limiting position according to the disclosure.

In order for the technical problems, technical solutions, and beneficial effects of the disclosure to be clearer and understandable, the disclosure is further described in detail below with reference to the accompanying drawings and embodiments. It should be understood that the specific embodiments described herein are only used to explain the disclosure, but not to limit the disclosure.

As shown in FIG. 1 to FIG. 7, a spray gun shower head of the disclosure includes the following.

A shower body 1 has a water intake opening 11 and at least one first and second water outflow openings 12 and 13. The first water outflow opening 12 of the shower body 1 is defined as the shower head water with normal shower function. It should be noted that the shower body 1 may have multiple water outflow openings for normal shower, that is, a multifunctional shower head, which may include inner circle water outflow, outer circle water outflow, etc.

A waterway closing element 2 is movable between at least two first and second switch positions 14 and 15. The waterway closing element 2 of the disclosure is configured as a water dividing member 2 that is at least rotatable. The switching and water outflow between the first and second water outflow openings 12 and 13 are implemented through the water dividing member 2.

The waterway closing element 2 opens a first water passageway 16 oriented from the water intake opening 11 toward the first water outflow opening 12 and cuts off a second water passageway 17 oriented from the water intake opening 11 toward the second water outflow opening 13 in the first switch position 14. That is, when the waterway closing element 2 (the water dividing member 2) rotates to the shower head water for normal shower, the second water outflow opening 13 is closed. It needs to be explained that the second water passageway 17 here is configured as a passageway for spraying spray gun water.

The second water outflow opening 13 and the second water passageway are hidden in the shower body 1 through a cover 3. In the disclosure, the second water outflow opening 13 is disposed on a top portion of the shower body 1, and the water outflow direction is arranged at an artificially set angle with the water outflow direction of the first water outflow opening 12, so that the water outflow opening of the spray gun water and the water outflow opening of the shower function are obviously distinguished. Also, when using the spray gun water function, the hand holding posture is more suitable and convenient for a user to use. In the disclosure, the cover 3 is hinged to the shower body 1 (preferably, the cover 3 is hinged to a back surface of the shower body 1 and blocks the second water outflow opening 13). The cover 3 is pushed against by an opening structure, including a push block 41, a movable element 42, and an elastic member 43, to be opened. It should be noted that the cover 3 is hinged to the back surface of the shower body 1, which not only does not affect the normal water outflow and appearance of the shower function, but also has a prompt effect on the shower body 1 for using the high-pressure spray gun water.

When the waterway closing element 2 is rotated to the second switch position 15, the opening structure is driven to push against the cover 3 to be flipped up, the first water passageway 16 from the water intake opening 11 toward the first water outflow opening 12 is cut off, and the second water passageway 17 from the water intake opening 11 toward the second water outflow opening 13 is opened. That is, the push block is used to cooperate with the waterway closing element 2, so as to implement the switching of the spray gun water while implementing the closing of the cover 3. Two functions are controlled by one action, which saves manufacturing costs and has a more compact structure.

In the first solution, the waterway closing element 2 directly acts on the cover 3 without any transmission and reset structure therebetween. The push block 41 is configured in the waterway closing element 2. A passive part 31 that cooperates with the push block 41 is disposed on the cover 3. The user manually drives the waterway closing element 2 to rotate, thereby linking the push block 41 thereon to press against the passive part 31, so that the cover 3 opens relative to the shower body 1, and the second water passageway 17 from the water intake opening 11 toward the second water outflow opening 13 is opened. The solution has a compact and simple structure, but the pressure of water flow needs to be overcome when switching, so the operation sensation is slightly worse.

In the second solution, a transmission and reset structure is disposed between the waterway closing element 2 and the cover 3. Similarly, the push block 41 is configured on the waterway closing element 2. The passive part 31 that cooperates with the push block 41 is disposed on the cover 3. The movable element 42 is movably disposed on the shower body 1. The movable element 42 forms an attachment part 420 that cooperates with the passive part 31 on the cover 3, and a pressure part 421 that pushes against the movable element 42 through the push block 41. Specifically, the shower body 1 of the embodiment is disposed with a through slot B. The movable element 42 is a rod body, and the rod body is slidably disposed within the through slot B. Two ends of the second spring 43 respectively act on the through slot B of the shower body 1 and the movable element 42, and are configured to drive the movable element 42 to reset without the pressure of the push block 41. The movable element 42 is displaced after being pressed against by the push block 41, and pushes against the passive part 31 after moving, thereby driving the end of the cover 3 away from the passive part 31 to open the second water outflow opening 13 with a hinge axis A as the fulcrum. The solution requires small acting force, is easy to implement, and may be reset through the elastic member 43 after switching, so the user experience is better.

The disclosure also provides a stopping member 5 to implement double protective effects, so as to prevent misoperation. When the stopping member 5 falls into a second limiting position 19, the waterway closing element 2 cannot be rotated to the spray gun water mode, which prevents the user from opening the high-pressure spray gun water during the normal bathing process and prevents the user from spraying the spray gun water to the ceiling, bath heater, socket, etc. due to misoperation, so as to have a good protective effect.

A rib 6 is further included, which is installed on the shower body 1. The rib 6 is disposed on the waterway closing element. The stopping member 5 is switchable to move at least between the first and second limiting positions 18 and 19. The second limiting position 19 is disposed on the rotational movement track of the rib 6. The stopping member 5 falls into the second limiting position 19 to block the rib 6 from crossing over, so as to limit the waterway closing element 2 from opening the second water outflow opening 13. It should be noted that the stopping member 5 is located in the first limiting position 18 to open the first water outflow opening 12. The stopping member 5 moves to the second limiting position 19 to limit the rotation of the waterway closing element 2 to the second switch position 15, which is configured to prevent the second water outflow opening 13 from spraying spray gun water upward when water supply is not stopped.

Figure 5:
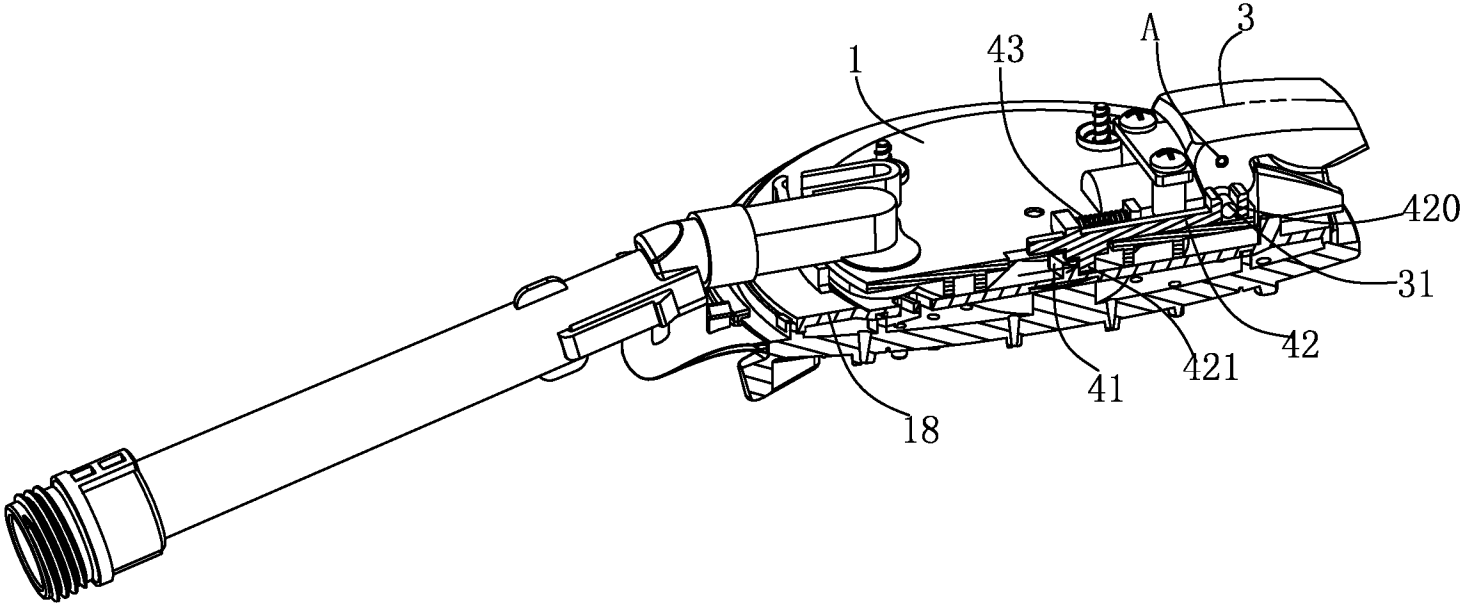
FIG. 5 is a three-dimensional cross-sectional view of the spray gun shower head according to the disclosure.
Figure 6:
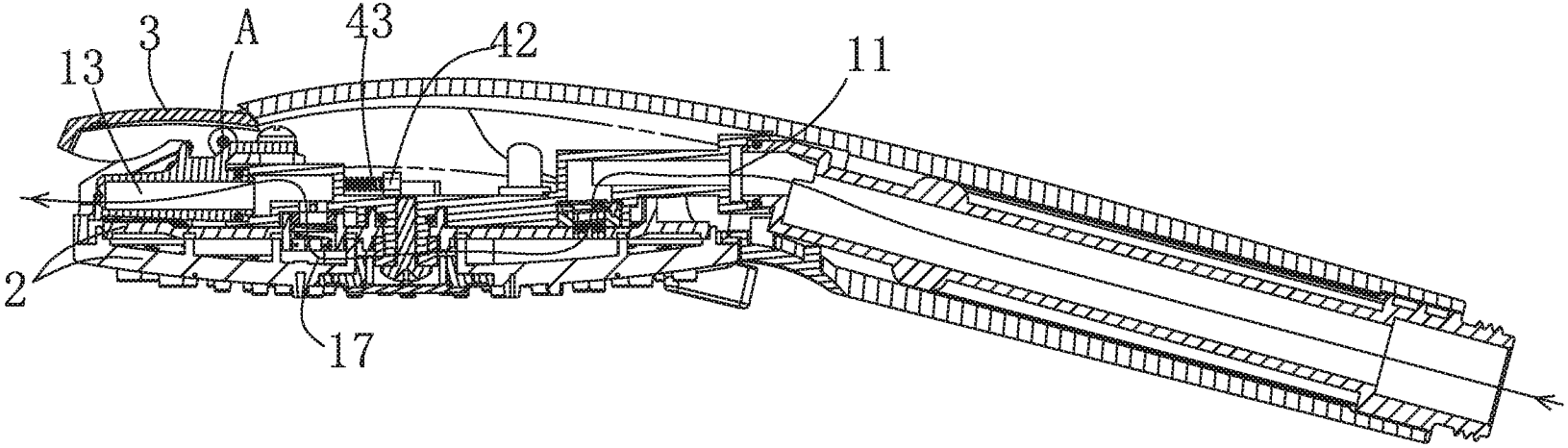
FIG. 6 is a cross-sectional view of the spray gun shower head in a spray gun water function state according to the disclosure.
Figure 7:
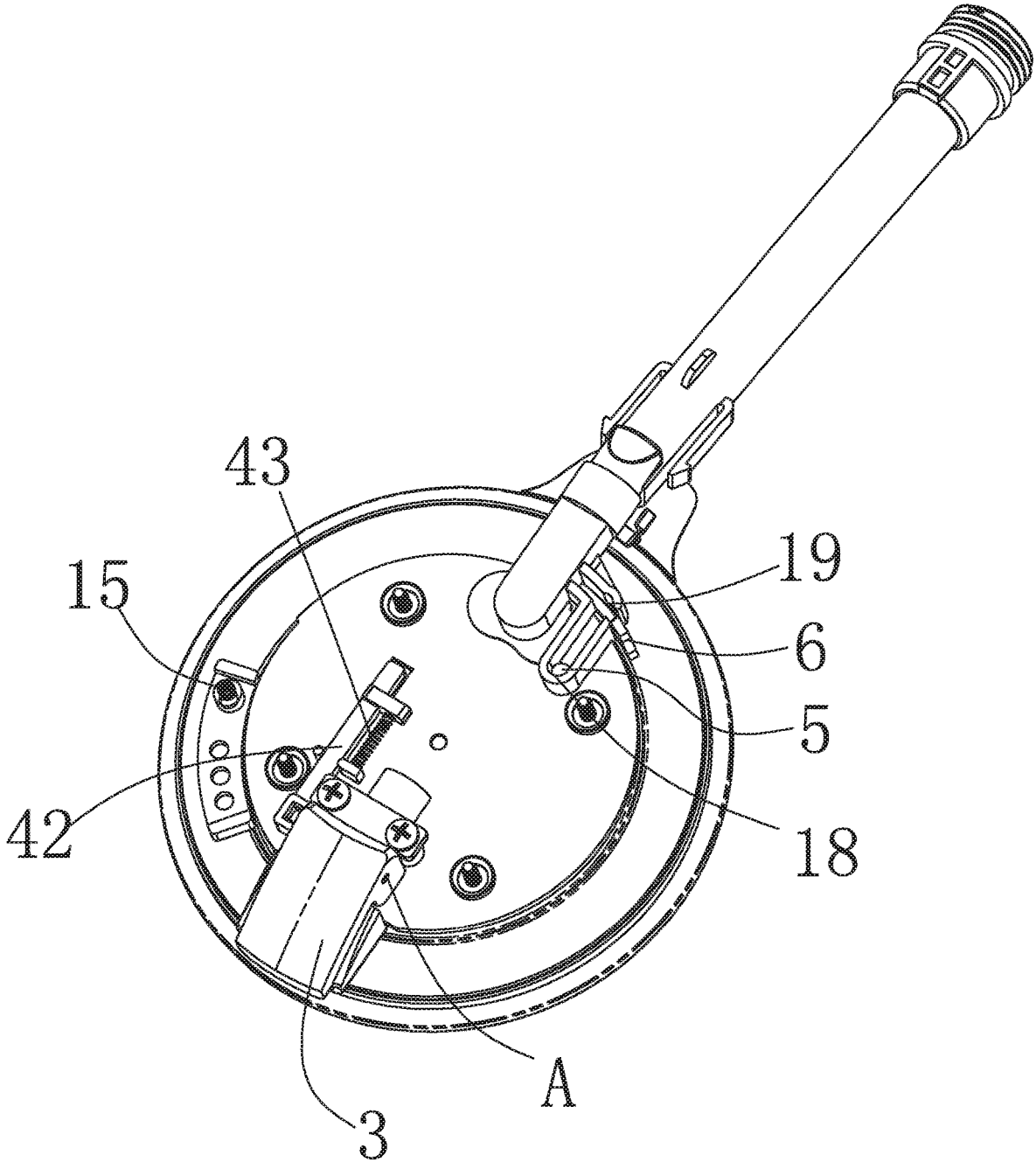
FIG. 7 is a three-dimensional view of the stopping member in a second limiting position according to the disclosure.

Specifically, the disclosure uses the stopping member 5 as a gravity ball. The movement direction of the stopping member 5 from the first limiting position 18 toward the second limiting position 19 is opposite to the water outflow direction of the second water outflow opening 13. The first limiting position 18 of the disclosure is disposed above the second limiting position 19, that is, close to the center position of the shower body 1, and the second limiting position 19 is disposed on the movement track of the waterway closing element 22. When the second outflow opening 13 (the water outflow opening of the spray gun water) faces downwards, as shown in FIG. 1 to FIG. 4, the gravity ball rolls down from the second limiting position 19 to the first limiting position 18. At this time, the shower head may be switchable between any modes, that is, the shower head could spray the normal shower head water, and could also spray the spray gun water by opening the cover 3 after crossing over the second limiting position 19. As shown in FIG. 5 to FIG. 7, when the second water outflow opening 13 faces upward or is tilted upward, the gravity ball rolls down from the first limiting position 18 to the second limiting position 19. At this time, the shower head may be switchable between any of the shower function modes arbitrarily. However, the switching of the spray gun water function is restricted by the gravity ball which cannot be crossed over to open the second water outflow opening 13, thereby having the effect of preventing accidental spraying.

The spray gun shower head provided by the disclosure has a simple structure, a reasonable design, and easy implementation. The switching function of the existing shower head and the spray gun function are integrated in the same rotational operating structure. Only one rotational structure could implement the spraying of the normal shower head water and the spraying of the spray gun water, which is easier for the user to operate and has better user experience. In addition, the water outflow opening of the spray gun water is covered and hidden with the cover, which not only has a good protective effect, but also serves as a prompt effect after opening the cover, so that the high-pressure spray gun water is not easily triggered. By the cooperation between the push block and the waterway closing element, the disclosure could implement the switching of the spray gun water while implementing the closing of the cover. Two functions are controlled by one action, which saves manufacturing costs and has a more compact structure. The cover of the disclosure is disposed on the shower body by adopting a hinged manner. The movable element and the elastic member serve as the transmission structure. The cover swings relative to the shower body and is opened by the rotational movement, and is automatically reset when switched to other functions (such as shower function). In the disclosure, the water outflow opening of the spray gun water is disposed on the top portion of the shower body and is disposed at a certain angle a water outflow opening of the shower function, so that the water outflow opening of the spray gun water and the water outflow opening of the shower function are obviously distinguished. Also, when using the spray gun water function, the hand holding posture is more suitable and convenient for the user to use. In addition, the cover is hinged to the back surface of the shower body, which not only does not affect the water outflow and appearance of the shower head part, but also has a prompt effect on the back cover for using the high-pressure spray gun water. The disclosure also provides a stopping member, which has the effect of preventing false triggering. When the stopping member falls into the second limiting position, the waterway closing element cannot be rotated to the spray gun water mode, which prevents the user from opening the high-pressure spray gun water during the normal bathing process and prevents the user from spraying the spray gun water to the ceiling, bath heater, socket, etc. due to misoperation, so as to have a good protective effect. In the disclosure, the second limiting position is disposed in the rotational movement track of the push block. When the stopping member is in the second limiting position, the stopping member cannot be triggered. When the stopping member crosses over the second limiting position, the spray gun water may be continuously released. The disclosure uses the gravity ball as the stopping member. Also, the movement direction of the stopping member from the first limiting position toward the second limiting position is opposite to the direction of the second water outflow opening. Such configuration enables the stopping member to be always in the second limiting position when the spray gun opening is facing upward, which cannot be opened by misoperation.

The above descriptions illustrate and describe the preferred embodiments of the disclosure. As mentioned above, it should be understood that the disclosure is not limited to the form disclosed herein, and should not be regarded as an exclusion of other embodiments, but may be used for various other combinations, modifications, and environments, and may be modified through the above teachings or technology or knowledge in related fields within the scope of the inventive concept described herein. The modifications and changes made by persons skilled in the art do not depart from the spirit and scope of the disclosure, and should fall within the protection scope of the appended claims of the disclosure.

What is claimed is:

1. A spray gun shower head, comprising:

a shower body, having a water intake opening and at least one first water outflow opening and at least one second water outflow opening; and a waterway closing element, moving between a first switch position and a second switch position, wherein the waterway closing element opens a first water passageway oriented from the water intake opening toward the first water outflow opening and cuts off a second water passageway oriented from the water intake opening toward the second water outflow opening in the first switch position, wherein the second water passageway is configured as a passageway for spraying water, the second water outflow opening and the second water passageway are hidden in the shower body through a cover hinged to the shower body, and the waterway closing element is configured as a water dividing member that is at least rotatable, the spray gun shower head further comprising:

a push block, configured in the waterway closing element, and a passive part that cooperates with the push block, wherein the passive part is disposed on the cover, wherein when the waterway closing element is rotated to the second switch position, the push block presses against the passive part, so that the cover opens relative to the shower body, the first water passageway oriented from the water intake opening toward the first water outflow opening is cut off, and the second water passageway oriented from the water intake opening toward the second water outflow opening is opened; and a movable element and an elastic member, wherein the movable element is movably disposed on the shower body, and forms an attachment part that cooperates with the passive part on the cover and a pressure part that pushes against the movable element to move through the push block, wherein the elastic member comprises a first and a second end, the first end acts on the shower body and the second end acts on the movable element, act on the shower body and the movable element, and are configured to drive the movable element to reset when the movable element is not being pressed against by the push block, and the movable element is displaced after being pressed against by the push block and drives the cover to swing with a hinge axis as a fulcrum to open the second water outflow opening.

2. The spray gun shower head according to claim 1, wherein the second water outflow opening is disposed on a top portion of the shower body, a water outflow direction of the second water outflow opening is arranged at an artificially set angle with a water outflow direction of the first water outflow opening, and the cover is hinged to a back surface of the shower body and blocks the second water outflow opening.

3. The spray gun shower head according to claim 1, further comprising a stopping member, disposed on the shower body, the stopping member is switchable to move between at least two limiting positions, the stopping member located in a first limiting position opens the first water outflow opening, and the stopping member moves to a second limiting position to limit rotation of the waterway closing element to the second switch position, so as to prevent the second water outflow opening from spraying the water upward when water supply is not stopped.

4. The spray gun shower head according to claim 3, wherein the second limiting position is disposed on a rotational movement track of the push block, and the stopping member falls into the second limiting position to limit the waterway closing element from opening the second water outflow opening.

5. The spray gun shower head according to claim 4, wherein a rib is disposed on the waterway closing element, the second limiting position is disposed on a rotational movement track of the rib, the stopping member falls into the second limiting position to restrict the rib from crossing over, so as to limit the waterway closing element from opening the second water outflow opening.

6. The spray gun shower head according to claim 5, wherein a movement direction of the stopping member from the first limiting position to the second limiting position is opposite to a water outflow direction of the second water outflow opening.

7. The spray gun shower head according to claim 6, wherein the stopping member is a gravity ball.

* * * * *